US011253050B2

(12) United States Patent
Green

(10) Patent No.: US 11,253,050 B2
(45) Date of Patent: Feb. 22, 2022

(54) BINDLE BLANKET

(71) Applicant: Calvin Jerome Green, Detroit, MI (US)

(72) Inventor: Calvin Jerome Green, Detroit, MI (US)

( * ) Notice: Subject to any disclaimer, the term of this patent is extended or adjusted under 35 U.S.C. 154(b) by 0 days.

(21) Appl. No.: 16/852,479

(22) Filed: Apr. 19, 2020

(65) Prior Publication Data

US 2021/0321753 A1 Oct. 21, 2021

(51) Int. Cl.
*A45F 4/02* (2006.01)
*A47G 9/02* (2006.01)

(52) U.S. Cl.
CPC ..... *A45F 4/02* (2013.01); *A47G 9/0223* (2013.01)

(58) Field of Classification Search
CPC ..... A45F 4/02; A47G 9/0223
See application file for complete search history.

(56) References Cited

U.S. PATENT DOCUMENTS 1,467,690 A * 9/1923 Schwarz ..... B65D 5/4287 206/315.1
2,792,576 A * 5/1957 Coady ..... A45F 4/02 5/640
3,092,223 A * 6/1963 Martin ..... A45F 4/02 190/1
3,262,283 A * 7/1966 Taylor ..... F25D 3/08 62/372
4,188,988 A * 2/1980 Agyagos ..... A45C 3/00 190/2
4,489,815 A * 12/1984 Martinez ..... A45C 9/00 190/1
4,841,587 A * 6/1989 Carter ..... A45C 3/10 455/344
4,967,986 A * 11/1990 Schildkraut ..... A45C 3/10 224/223
5,002,401 A * 3/1991 Blackman ..... A45C 7/0095 150/112
5,370,460 A * 12/1994 Nelson ..... A45F 4/02 383/4
D381,199 S * 7/1997 Glasser ..... D3/274
6,193,118 B1 * 2/2001 Kearl ..... A45C 7/0095 108/43
6,276,828 B1 * 8/2001 Otley ..... A45C 9/00 224/576
6,393,638 B1 * 5/2002 MacColl ..... A45F 4/02 383/4
7,028,870 B2 * 4/2006 Valdez-Campbell ..... A45C 7/0095 224/153
7,597,478 B2 * 10/2009 Pruchnicki ..... A45C 7/0077 224/578

(Continued)

*Primary Examiner* — Brian D Nash

(57) ABSTRACT

A moving pad that converts into a bag called a Bindle Blanket, as a moving pad it functions like a traditional moving pad or blanket used to wrap and protect furniture and vulnerable objects and used for padding to prevent furniture from shifting while being transported during a move. When converted from moving pad to a bindle, it functions as a flexible bag or sack at which time small miscellaneous or odds and ends can be loaded or packed within. Once loaded the Bindle Blanket can be carried by hand using the attached medial right and medial left side handles or the Bindle Blanket can be attached to the frame of a hand dolly and rolled to and from the transporting vehicle.

1 Claim, 12 Drawing Sheets

(56) References Cited

U.S. PATENT DOCUMENTS

| | | | | |
|---|---|---|---|---|
| 2006/0169691 | A1* | 8/2006 | Rothschild | A45C 13/1038<br>220/7 |
| 2008/0050050 | A1* | 2/2008 | Seecof | A45F 4/02<br>383/4 |
| 2014/0259404 | A1* | 9/2014 | Walker | A47G 9/0223<br>5/485 |
| 2014/0304913 | A1* | 10/2014 | Sova | A47G 9/0223<br>5/486 |
| 2017/0303668 | A1* | 10/2017 | Kesler | A45C 9/00 |

* cited by examiner

BINDLE BLANKET

BACKGROUND OF THE INVENTION

As a Professional mover over a period of 30 years Mr. Calvin Jerome Green noticed on various moves, customers seemingly have boxed or bagged all miscellaneous (odds and ends or nicknacks). But noticed some miscellaneous e.g. clothes, shoes, jewelry, dishes, china, vases, books, magazines, paper files, pictures and snacks, were hidden in hide-a-ways e.g. dresser drawers, chest of drawers, closets, nightstands, pantries, apartment storage units, desks, bookcases, credenzas, laundry rooms, attics, freezers, refrigerators, dryers, china cabinets, buffets, hutches, etcetera. These hide-a-way items hindered the facilitation of the moved. The fall back plan most of the time was handle by using pillow cases or spreading bed-sheets, bed-blankets or moving blankets on the floor, strategically loading them, tying the ends of the choice fabric in a bundle and carry or roll the bundle to and from the transporting vehicle. Thus, a need exists for a more efficient and simpler way for professionally packing of these items and loading them inside the transporting vehicle. Hence, the Bindle Blanket, a flexible bag, converted from a moving pad. Therefore, excluding the use of bedding and to the like. The Bindle Blanket could be utilized by professional movers as a fall back plan for those hidden items left in hide-a-ways and a great tool to be included in moving supplies for residents undertaking their own move.

BINDLE BLANKET DESCRIPTION

Figure 1:
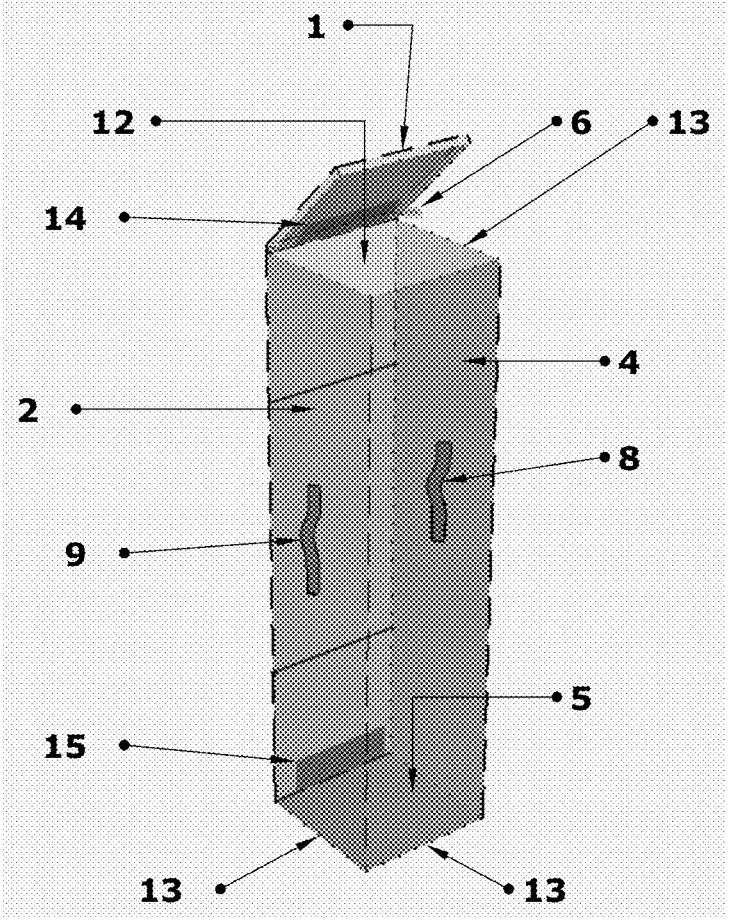
FIG. 1 is a perspective x-ray view of the Bindle Blanket converted into a bindle (12).
Figure 2:
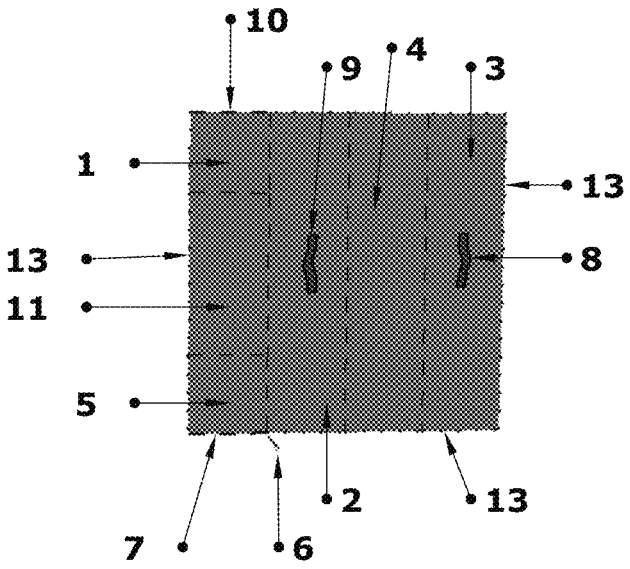
FIG. 2 is a top side view of the Bindle Blanket as a moving pad with top lid (1) and bottom lid (5) secured inside of top lid pocket (10) and bottom lid pocket (7).
Figure 3:
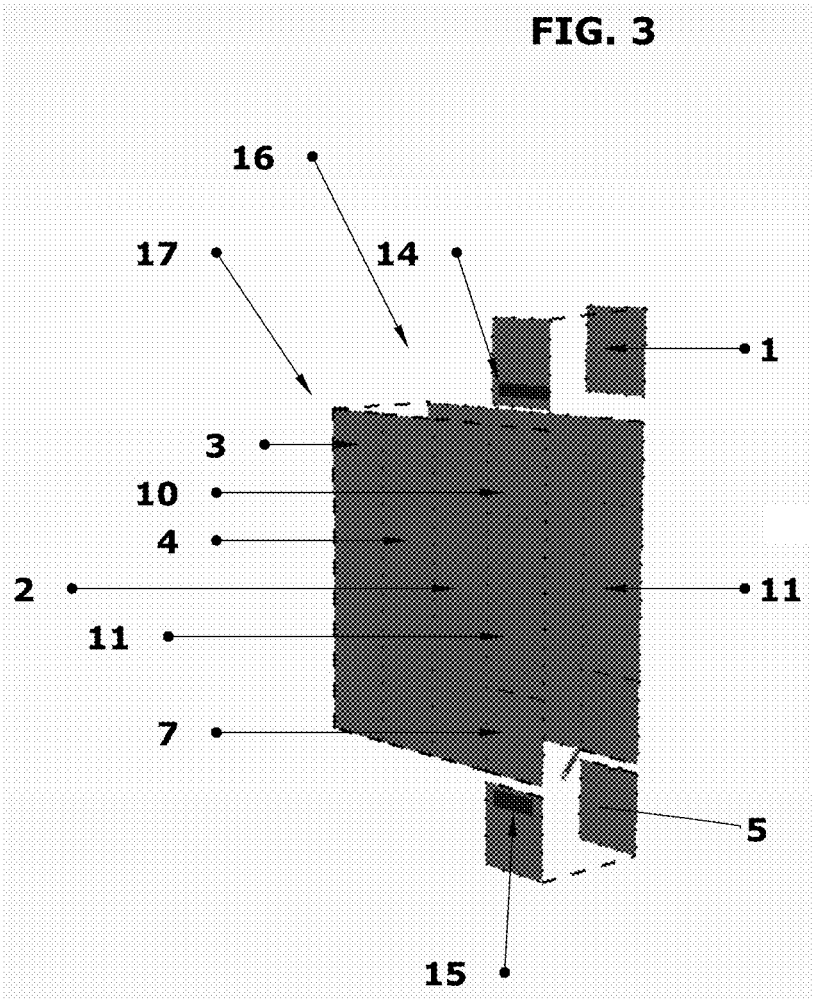
FIG. 3 is a vertical sectional view of the Bindle Blanket, showing interior (17), exterior (16), Velcro strip (hook and loop) at the rim (14) of top lid pocket and Velcro strip (hook and loop) at the rim (15) of the bottom lid pocket. Both top and bottom lid have been detached from moving pad to show interior and exterior.
Figure 4:
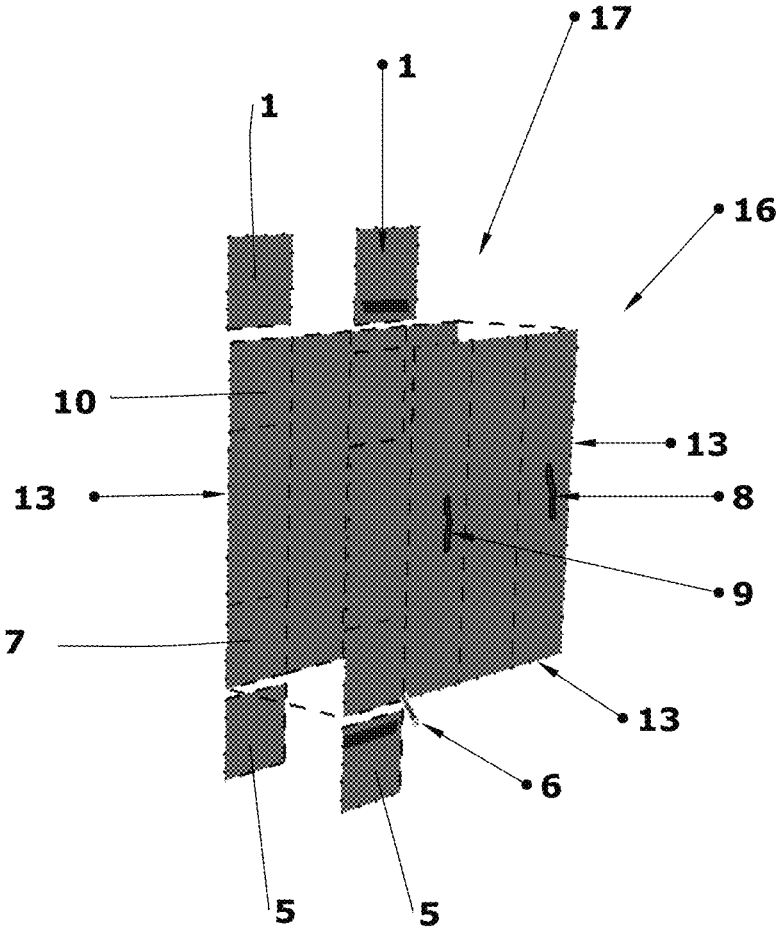
FIG. 4 is a vertical sectional view of the Bindle Blanket, showing exterior (16), interior (17), Velcro strip (hook and loop) at the rim (14) of top lid pocket and Velcro strip (hook and loop) at the rim (15) of the bottom lid pocket. Both top and bottom lids have been detached from moving pad to show exterior and interior.
Figure 5:
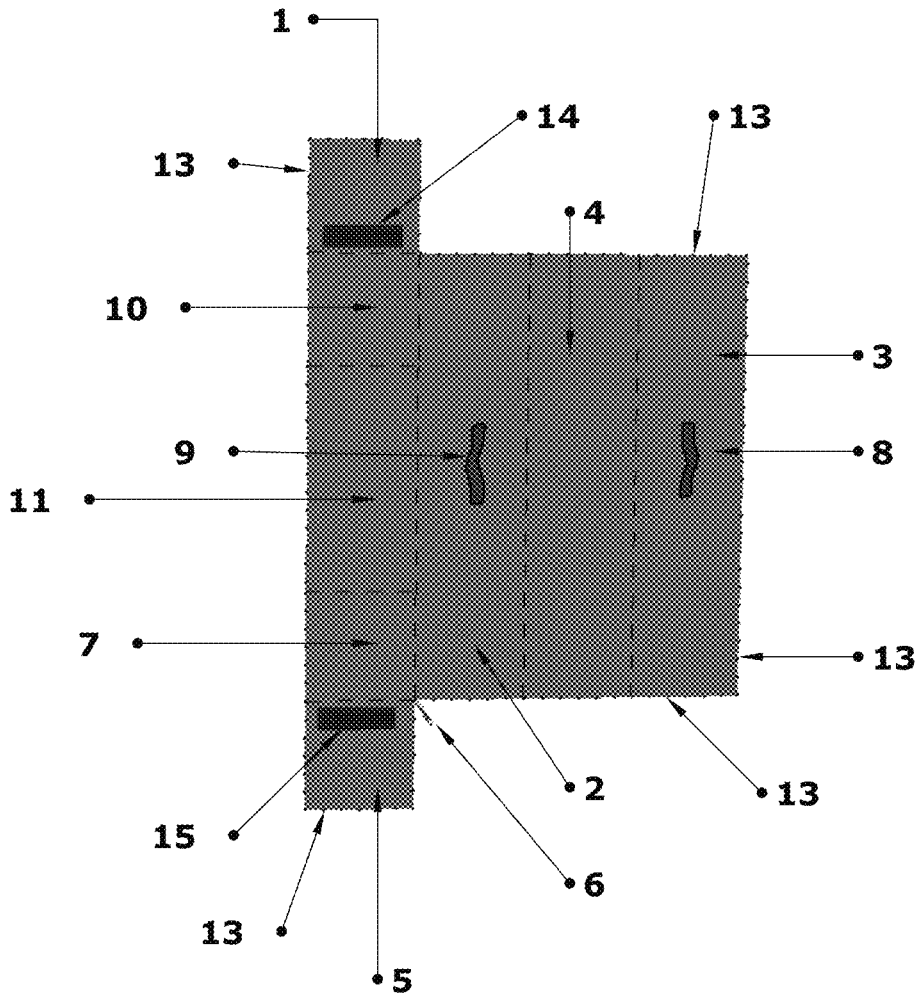
FIG. 5 is a top side spread view of the Bindle Blanket with top lid (1) everted from top lid pocket (10), and bottom lid (5) everted from bottom lid pocket (7) by detaching Velcro strips (hook and loop) at the rims of the top pocket (10) and the bottom pocket (7), phase one of conversion from moving pad to bindle.
Figure 6:
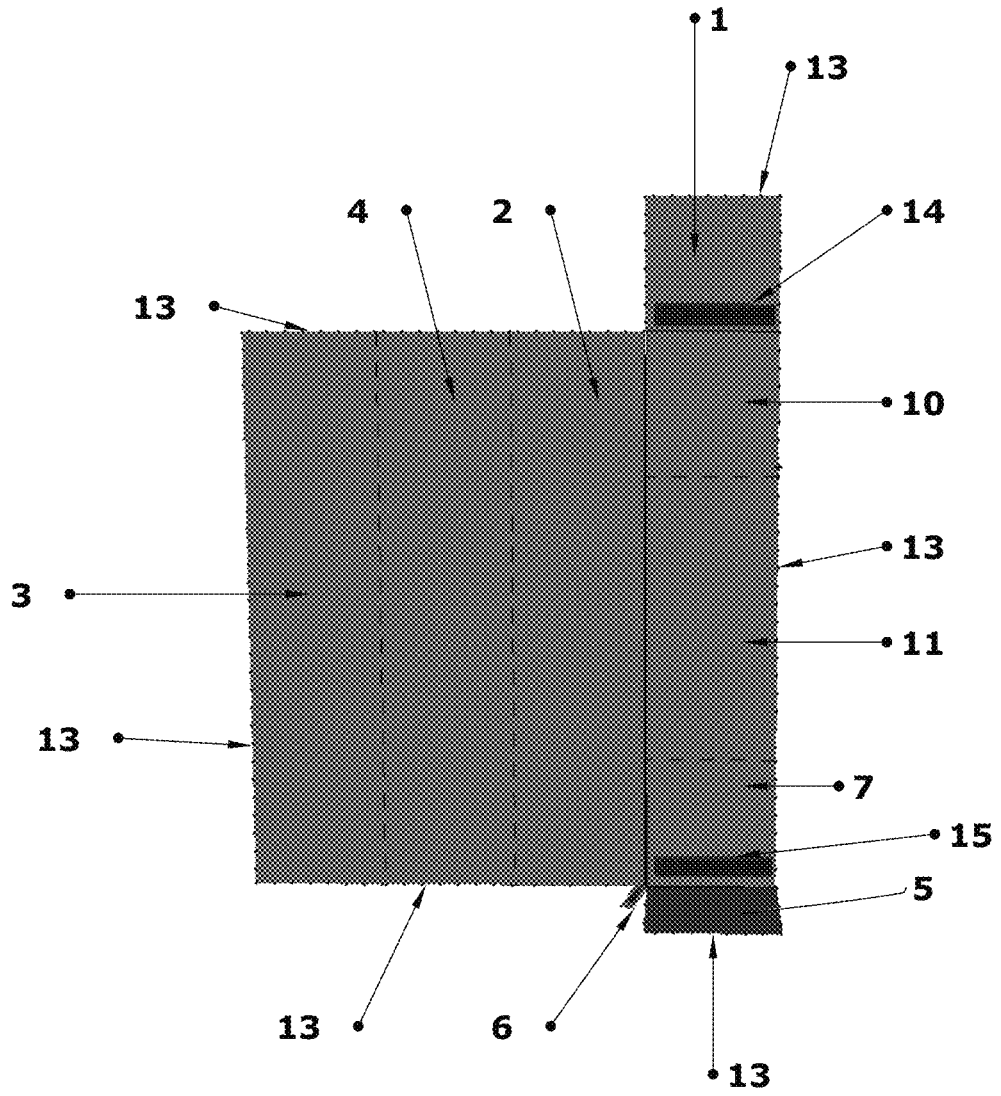
FIG. 6 is a vertical view of the Bindle Blanket with bottom lid (5) parallel exposing the pull zipper (6), phase two of conversion from moving pad to bindle.
Figure 7:
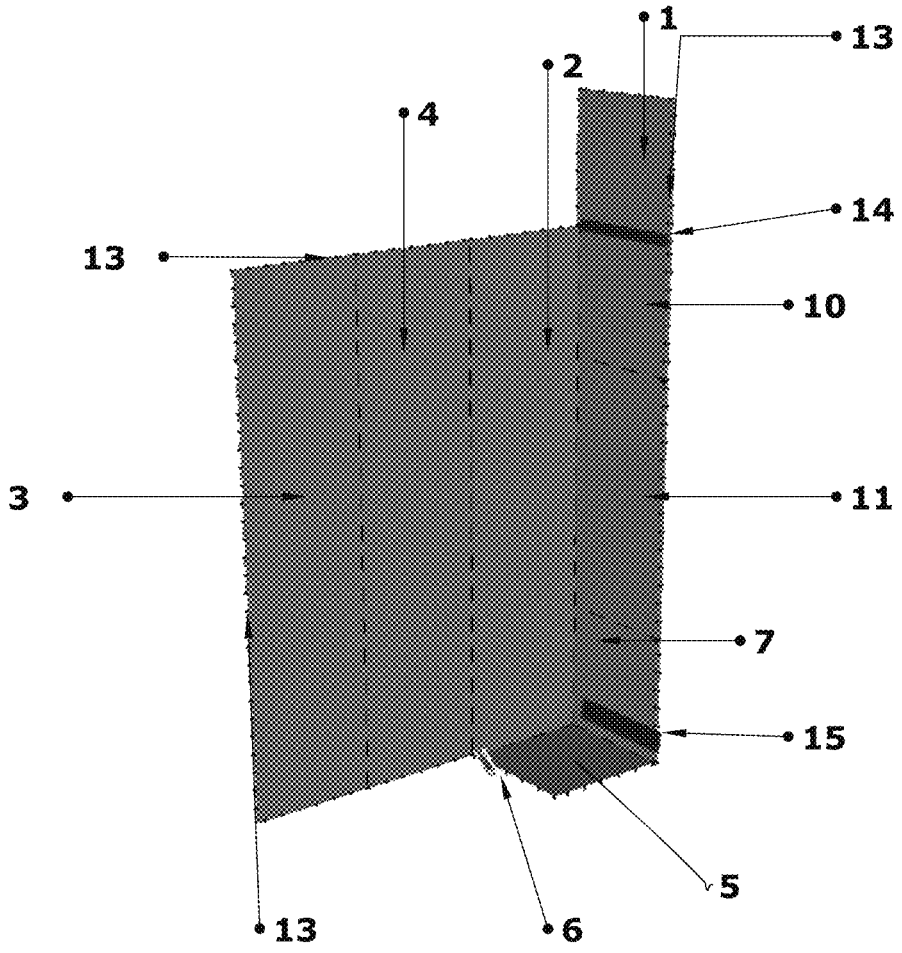
FIG. 7 is a vertical view of the Bindle Blanket with bottom lid (5) parallel to right panel (2) from pull zipper (6) onto zipper border track (13) binding right panel (2), phase three of conversion from moving pad to bindle.
Figure 8:
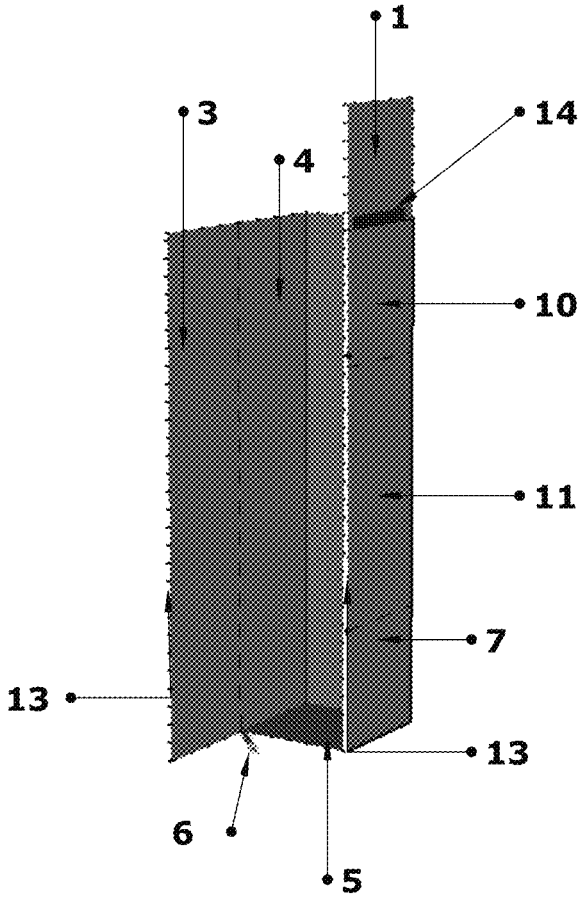
FIG. 8 is a vertical view of the Bindle Blanket with bottom lid (5) parallel to right panel (2) and front panel (4) bind together from pull zipper (6), phase four of conversion from moving pad to bindle.
Figure 9:
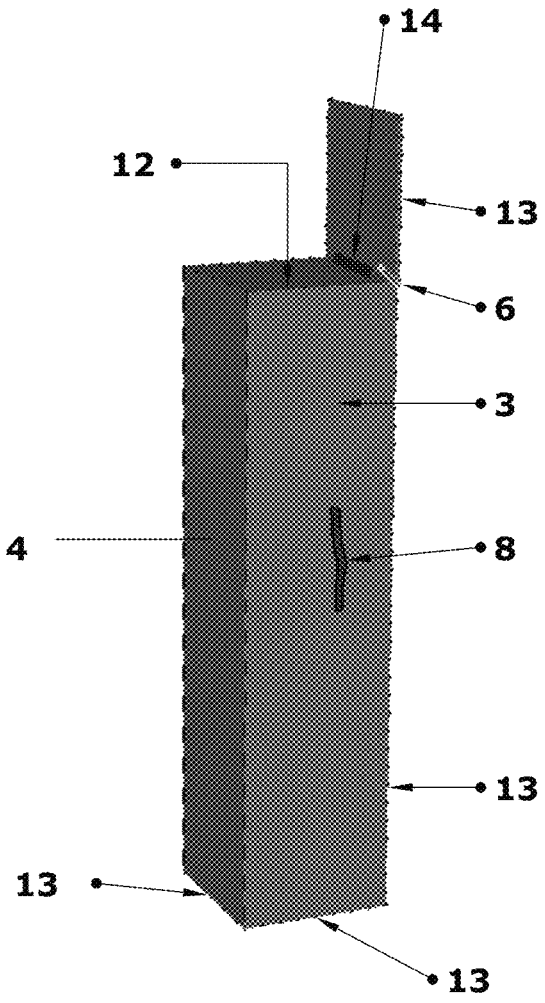
FIG. 9 is a vertical view of the Bindle Blanket with bottom lid (5) parallel to right panel (2), front panel (4) and right panel (3) bind together from pull zipper (6) further on zipper border track (13), and bind together panel (11) by vertical pull zipper (6) on zipper border track (13) to top left corner of top lid (1) phase five of conversion which form the bindle.
Figure 10:
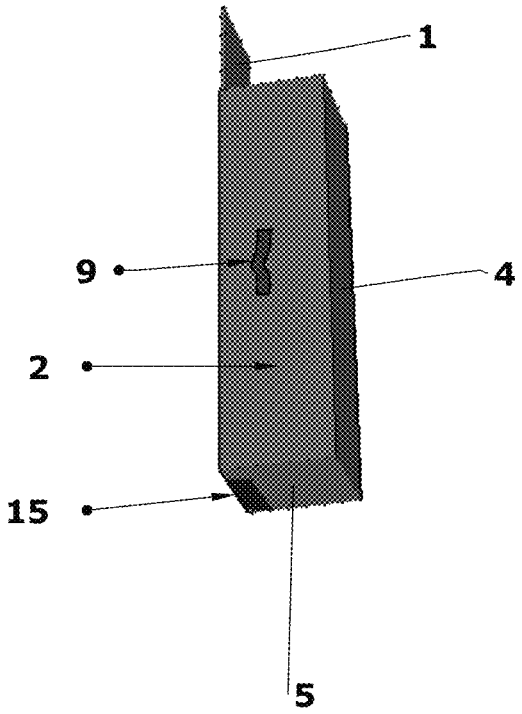
FIG. 10 is an elevated view of the Bindle Blanket
Figure 11:
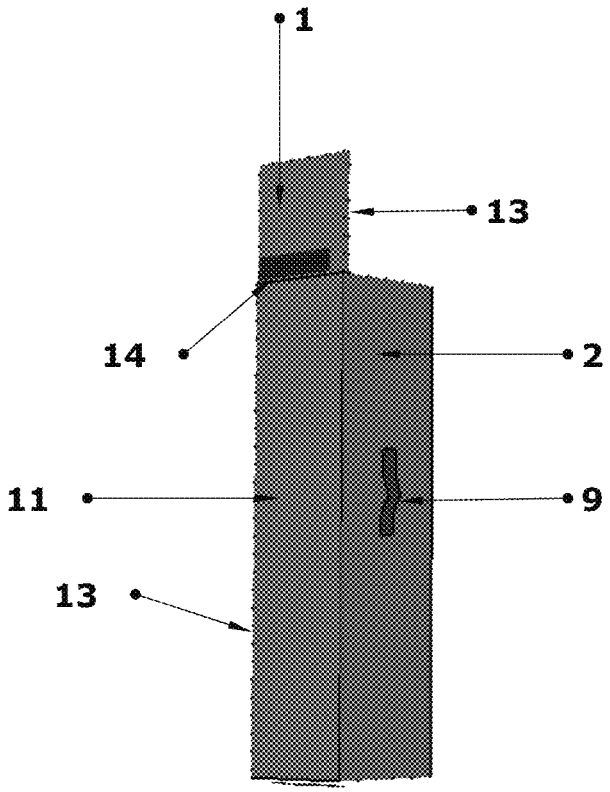
FIG. 11 is a perspective right side view of the Bindle Blanket with top lid open for the purpose of packing or loading the bindle.
Figure 12:
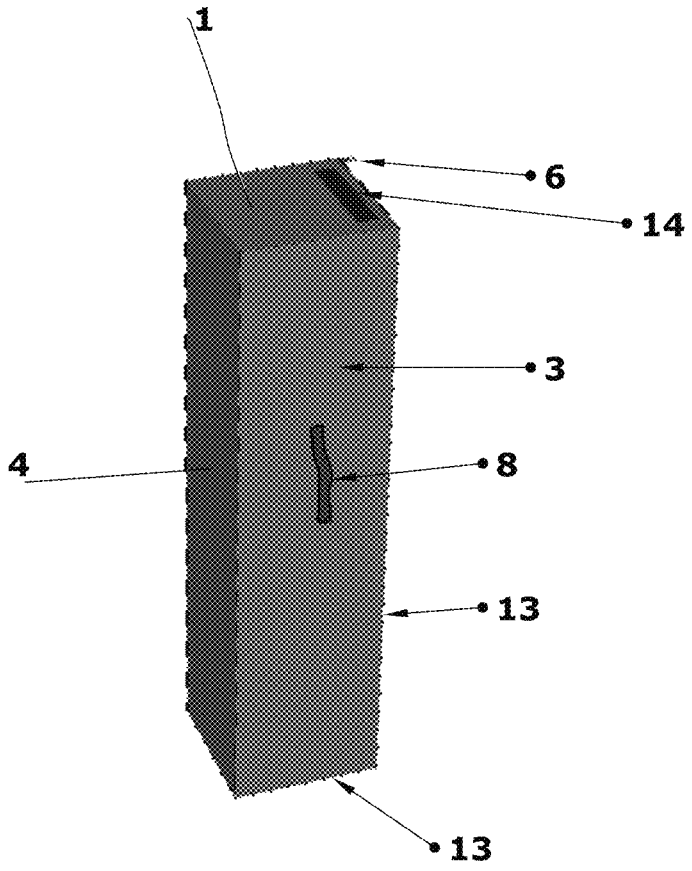
FIG. 12 is a left side view of the Bindle Blanket with top lid (1) closed by pull zipper (6) further on the zipper border track (13) from left corner of top lid (1) corner to the right corner of the top lid (1) corner. For the purpose of protecting and securing the contents within to be carried by hand by its attached medial right side handle ((9) and medial left side handle (8) or the Bindle Blanket can be attached to a hand dolly and rolled to and from the transporting vehicle.

The Bindle Blanket is a moving pad that could be converted into a flexible bag called a Bindle, fabricated from canvas, cotton, and polyester, design with evenly matched length and width sides, unlike traditional moving pads with unmatched length and width sides. The Bindle Blanket is comprised of a top lid (1), bottom lid (5), top lid pocket (10) bottom lid pocket (7), with inter locking Velcro strips (hook and loop) at the rim of top pocket (14), inter locking Velcro strips (hook and loop) at the rim of bottom lid pocket (15) a pull zipper (6) located at the hollow of the bottom lid pocket (7) a zipper border track (13) that encompasses the entire edge of the bindle blanket called the zipper border track FIGS. 5, 6, 7 and 8, four sides labeled panels: rear panel (11), front panel (4), right panel (2) with attached medial handle (9), left panel (3) with attached medial handle (8), both handles fabricated from nylon. The Bindle Blanket before conversion function as a moving pad shown in FIG. 2, a top spread view, with both top lid (1) inverted in top lid pocket (10) and bottom lid (5) inverted in bottom lid pocket (7). the Bindle Blanket as a moving pad wraps and protects furniture and vulnerable objects by a resident or mover during a move. For storage or packing purposes of small miscellaneous, the Bindle Blanket as a moving pad is converted from a moving pad to a Bindle by detaching Velcro strips (hook and loop) at the rim of the top pocket (14) and Velcro strips (hook and loop) at the rim of the bottom lid pocket (15) Then everting bottom and top lids from top and bottom lid pockets shown in FIG. (5) a top spread, exterior view (16) of the Bindle Blanket with top lid (1) everted from top lid pocket (10) and bottom lid (5) everted from bottom lid pocket (7). Exposing pull zipper (6) and zipper border track (13). To complete transformation, pull zipper onto zipper border track from the hollow of bottom lid pocket (7) completing full zipper pull to top lid (1) binds together bottom lid (5), right panel (2), front panel (4), and left panel (3) to the left corner of top lid (1), unzipped FIGS. 1,9,10, and 11 which completed the conversion from moving pad to bindle in which a number of small miscellaneous could be packed or loaded inside the Bindle. Once loaded, secure top lid by zipper pulling on zipper border track from left end of the corner of the top lid (1) to the right end of the same. Once loaded and secured FIG. 12 the Bindle Blanket can be hand carried by the mover or resident by lifting up the Bindle by its left (14) and right (15) medial handles or the Bindle Blanket can be attached to the frame of a hand dolly and conveniently and effortlessly rolled to and from the transporting vehicle.

I claim:

1. A bindle blanket that functions as a moving pad and a flexible bag, the bindle blanket comprising: a square shaped moving pad that converts into a flexible zip up bag called a bindle, the bindle fabricated from canvas, cotton, and polyester, the bindle comprising: a front panel, rear panel, a left side panel and a right side panel, two opposing side panels with attached medial handles fabricated from nylon, a bottom lid, with a bottom lid pocket, a top lid with a top lid pocket, at the rim of both lid pockets are hook and loop fasteners, wherein the bottom and top lid pockets seal the top lid and bottom lid when the bindle bag is inverted, a pull zipper at a hollow of the bottom lid pocket, and a zipper track that covers the entire bindle blanket border.

* * * * *